US005593160A

United States Patent [19]

Constantine et al.

[11] Patent Number: 5,593,160

[45] Date of Patent: Jan. 14, 1997

[54] PICTORIAL COMPETITION ENTRY METHOD AND MEANS AND APPARATUS FOR CONDUCTING SAID COMPETITION

[76] Inventors: William Constantine; William R. Constantine, both of 18 Lawson Road, Seaton Carew, Hartlepool, Cleveland TS25 1AD, England

[21] Appl. No.: 379,626

[22] PCT Filed: Aug. 10, 1993

[86] PCT No.: PCT/GB93/01696

§ 371 Date: Mar. 20, 1995

§ 102(e) Date: Mar. 20, 1995

[87] PCT Pub. No.: WO94/04234

PCT Pub. Date: Mar. 3, 1994

[30] Foreign Application Priority Data

Aug. 11, 1992 [GB] United Kingdom ..... 9216965

[51] Int. Cl.[6] ..... A63F 3/06

[52] U.S. Cl. ..... 273/139; 446/901; 283/903

[58] Field of Search ..... 446/901; 273/139, 273/240, 282.2; 283/51, 52, 49, 903, 101

[56] References Cited

U.S. PATENT DOCUMENTS

| | | | |
|---|---|---|---|
| 985,108 | 2/1911 | Brophy | 283/51 |
| 4,195,864 | 4/1980 | Morton et al. | 283/56 |

FOREIGN PATENT DOCUMENTS

| | | | |
|---|---|---|---|
| 654253 | 11/1993 | Australia | 283/51 |
| 1703290 | 11/1971 | Germany . | |
| 317960 | 8/1929 | United Kingdom . | |
| 1604651 | 12/1981 | United Kingdom | 283/51 |
| 2233240 | 9/1991 | United Kingdom . | |
| 2233241 | 9/1991 | United Kingdom . | |

*Primary Examiner*—Benjamin H. Layno
*Attorney, Agent, or Firm*—Rodman & Rodman

[57] ABSTRACT

A novel method of entering a pictorial competition of the type in which the position of an object omitted from a picture is required to be identified is in the form of a sheet on which a multiplicity of crosses or other indicia are displayed, the crosses being applied to a pictorial entry coupon in the position selected by the entrant. The crosses may be in the form of transferable markings on the sheet or the sheet itself, bearing the crosses, may be adhesively secured to the coupon by the entrant.

14 Claims, 2 Drawing Sheets

PICTORIAL COMPETITION ENTRY METHOD AND MEANS AND APPARATUS FOR CONDUCTING SAID COMPETITION

BACKGROUND OF THE INVENTION

The present invention relates to competitions of the well-known "Spot the Ball" type, wherein a competition entrant is required to place a cross upon a pictorial entry coupon to indicate, in the judgment of the entrant, the position of an object, for example the centre of a football notionally missing from the picture, which often consists of an action photograph from which the object has been deleted. Competitions of this type are acknowledged to be already known in GB-A-1604651, at page 1, lines 13 to 22 of that specification.

DESCRIPTION OF THE PRIOR ART

In GB-A-1604651 the difficulty of judging competitions of the foregoing type having a large number of entries is acknowledged. In such competitions, the entrant may usually mark the cross with ink, which may smudge or may, because of the width of the marking, give an imprecise indication of the intended position. Most entrants attempt to optimise their chances of success by placing a large number of crosses in what they consider to be the relevant area and, with that in mind, organisers of competitions may allow entrants to place, say, 500 crosses for an entry fee of as little as, say, £2.00. To facilitate entry on this scale, rubber stamps have now become readily available, by means of which an entrant is able to print many crosses simultaneously. In practice, however, these rubber stamps have proved to be far from satisfactory. As the crosses are very close together, a clear impression is not obtained unless the rubber stamp is kept spotlessly clean. Even then, unless the rubber stamp is uniformly coated with the right amount of ink, and unless it is applied to the entry coupon on a perfectly flat surface, for example a sheet of glass, some of the crosses may not be printed clearly or at all. Furthermore, entrants who have unsteady hands or impaired vision also have difficulty in using a rubber stamp effectively.

SUMMARY OF THE INVENTION

An object of the present invention is to provide a method of entering a pictorial competition, and also means and apparatus for conducting such a competition, whereby some at least of the disadvantages of prior such competitions are reduced or avoided.

The method according to the invention of entering a pictorial competition comprises applying one or more crosses or the like displayed on a sheet to the entry coupon in the desired position.

The competition entry means according to the invention comprises a sheet on which there is displayed one or more crosses or the like, the sheet being adapted to apply the crosses or the like to a pictorial competition entry coupon in a desired position so as to display the crosses or the like on the coupon.

The apparatus for conducting the competition comprises a pictorial competition entry coupon, a sheet on which there is displayed one or more crosses or the like, and rules specifying that the winner of the competition is the entrant who applies the crosses or the like from the sheet to, or most nearly to, a particular position on the entry coupon determined by said rules.

As will be apparent, an important feature of the competition entry method to which the present invention applies is that the crosses or the like to be applied to the entry coupon is/are supplied on a sheet which is distinct from the entry coupon—although it may be connected to the coupon. In a preferred form of the invention, a multiplicity of crosses are displayed on the sheet. To avoid undue repetition, further description herein will refer to "crosses" in the plural, but it should be understood that such description is applicable also to single crosses and to one or more like markings, for example stars or dots.

The crosses may be designed to be transferred from the sheet to the entry coupon, in which case they are preferably transferred by applying pressure to the sheet. That is the crosses are displayed on a so-called "transfer", from which they are transferred individually or en bloc to the entry coupon, the sheet ultimately being discarded. However it is much preferred that the crosses be applied by adhesively attaching the sheet to the entry coupon.

Thus, in a particularly preferred form of the present invention, the competition apparatus according to the invention comprises a pictorial competition entry coupon, one or more sheets, each sheet being adapted to be adhesively secured to the entry coupon and having thereon one or more crosses or the like, and rules specifying as aforesaid the manner of determining the competition winner.

Preferably, one side of each sheet is self-adhesive and is preferably attached to a peelable backing. For example the sheets may be provided with individual backing sheets or a plurality of sheets may be individually detachably mounted on a single backing. Alternatively, one side of each sheet may be coated with a water-activated adhesive, by means of which the sheet may be attached to the entry coupon.

The sheets may be supplied separately from the pictorial entry coupon. For example, they may be intended for application to an entry coupon appearing in a newspaper or magazine, in which case they may be supplied free of charge with the newspaper or magazine or sold separately, for example by a newsagent. In another form of the apparatus, the sheets may be supplied removably attached to the competition entry coupon or to an extension of that coupon, for removal and then application to the pictorial area of the coupon.

When the sheets are supplied separately from the entry coupon, a plurality of sheets may be interconnected separably by perforations. As one alternative, a plurality of sheets may be supplied arranged on a backing roll. As another, less preferred, alternative, the sheets may be intended to be cut to size or simply torn off by a competition entrant.

In all the forms of the sheet, the sheets may be transparent, translucent or opaque. Transparency may assist the entrant in placing the crosses with precision upon the entry coupon but may be unnecessary from the point of view of the checkers who have the task of identifying the winning entry.

The distribution of the crosses upon each sheet may be according to a predetermined pattern or may be random. As between different sheets, the concentration of the crosses may differ or the sheets may be of different sizes, with the crosses at the same concentration.

The pictorial entry coupon may comprise a photograph or drawing and the picture may be in colour or in black and white. The coupon may advantageously comprise two parts, one of which, comprising the competition entry, may be sent or handed to the competition organisers as the competition entry to be checked, while the other part may be retained by the entrant as his record of having entered the competition.

In a preferred form of the entry coupon, a two-part coupon bears a unique number or other form of coding on each part of the coupon by which any coupon may be identified. When a winning entry has been selected, the number or code of the winning coupon may be advertised, whereupon the winner of a competition using such a coupon need only present to the organisers the part of the coupon which he had retained in order to claim the prize. Such a code may also be used to check the authenticity of coupons entered in a competition or to identify the location at which the coupon was obtained, for example. The coupon may include a security device, which is present to distinguish authentic coupons from forged copies, such as a watermark or other mark such as a hologram or the like or a mark printed in a certain way so that it is visible only under certain conditions.

The coupon may optionally include a section for the competition entrant to write his name and/or address. The coupon may include space for advertising purposes or an area in which the competition rules or instructions for entering the competition may be printed.

The rules of the competition define how the particular winning position on the pictorial entry coupon is selected. In one form of the invention, the winning position corresponds to the position of a part of a photograph, for example, which was present in its original form but which has been omitted from the picture shown on the entry coupon. In another form, the winning position may be that judged to be the most appropriate position for the marker by a competition judge or judges. The rules may also provide additional information for the entrant, such as the dates between which the competition will be run, instructions for making a valid entry, etc.

The invention will now be further described with reference to the accompanying drawings, which illustrate, by way or example only, two preferred embodiments of the competition entry means and apparatus according to the invention and wherein:

DETAILED DESCRIPTION OF THE PREFERRED EMBODIMENT

Figure 1:
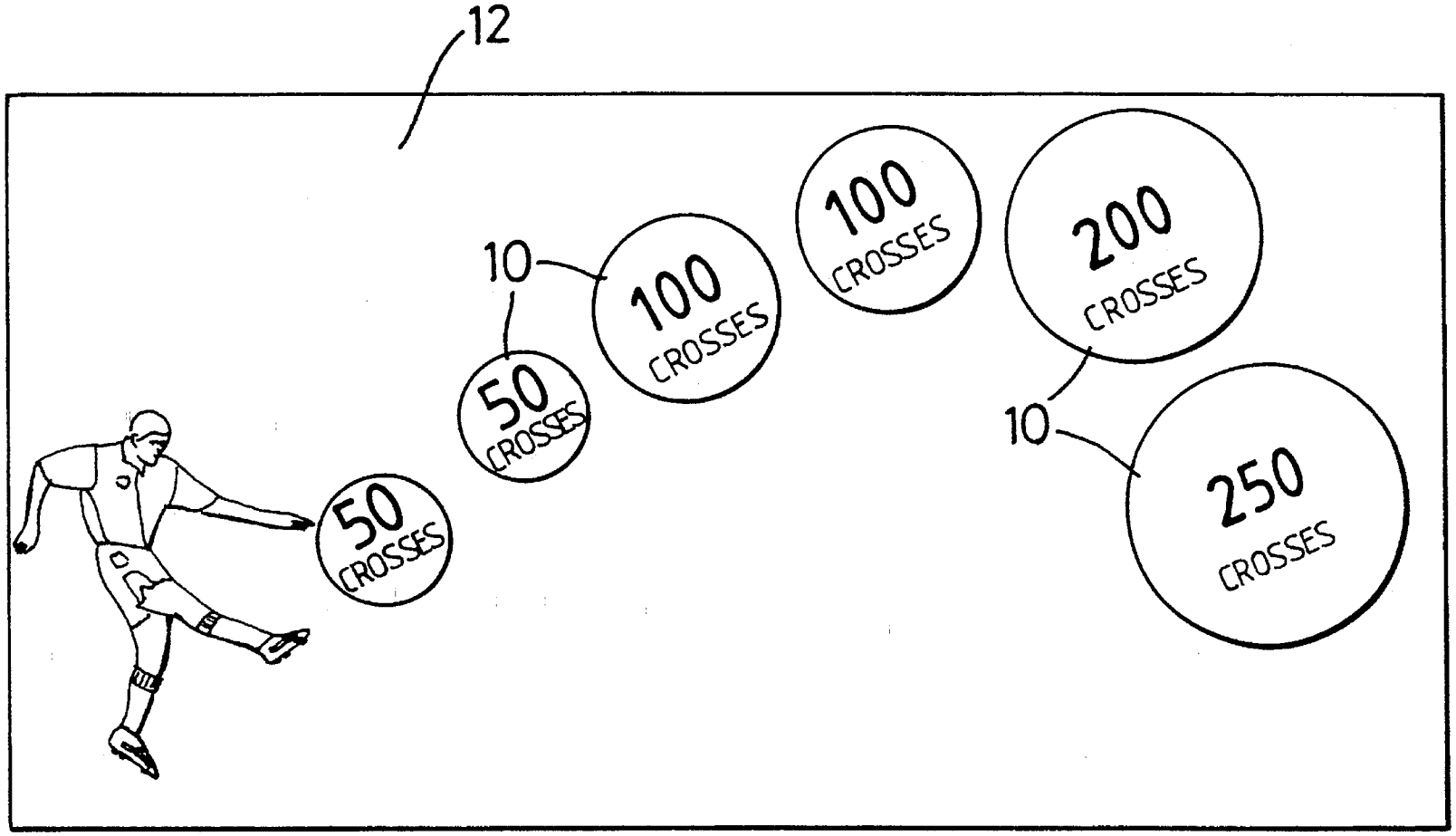
FIG. 1 is a schematic representation of a first embodiment of competition entry means.

Referring firstly to FIG. 1, a number of sheets 10 each have the form of a relatively small circular disc which simulates the outline of a football. One side of each sheet 10 is self-adhesive, and the sheets are peelably mounted on a single flat backing 12. Each sheet 10 is transparent so that a competitor can apply it to a conventional pictorial competition entry coupon in precisely the randomly chosen position which he or she considers to be the most relevant, and carries an indelible display of a multiplicity of precisely defined crosses arranged in a predetermined pattern. The discs on a single backing can all be of the same diameter and carry the same number of crosses, or can all be of the same diameter and carry different numbers of crosses at different concentrations or, as indicated not strictly to scale in the accompanying drawing, can be of different diameters and carry different numbers of crosses at the same concentration. Discs carrying different numbers of crosses can be colour-coded whilst remaining transparent, that is to say, can be tinted, or may be opaque and, if desired, colour-coded. The sheets do not need to be circular discs but can be square or any other shape. The backing can constitute a roll, or it can be flat as in the drawing, in which case it can be separate from or part of the entry coupon. Single self-adhesive sheets peelably mounted on individual backings can be supplied if desired.

Figure 2:
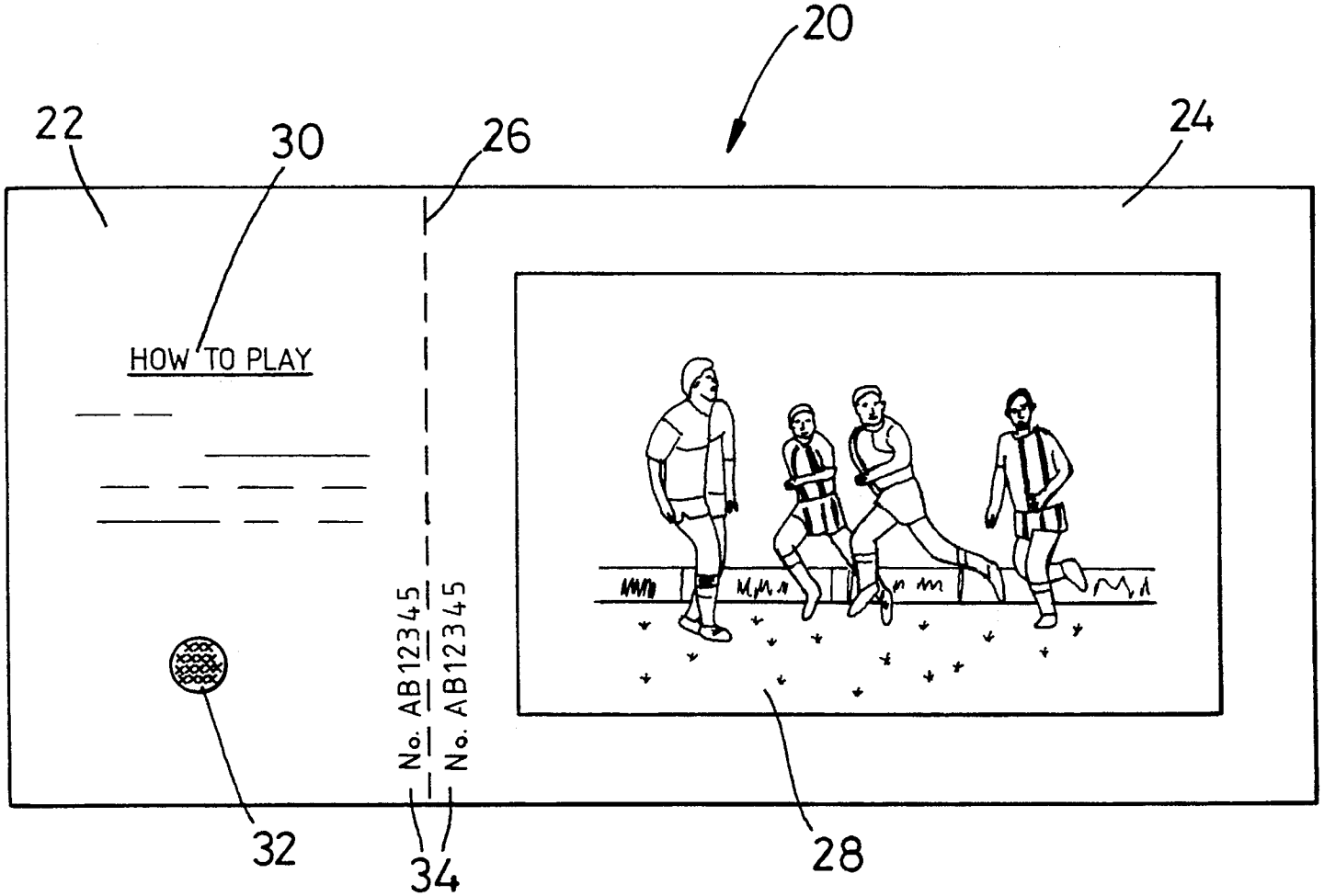
FIG. 2 is a schematic representation of a second embodiment of the competition apparatus.

The apparatus illustrated in FIG. 2 is a competition entry coupon, designated generally by the reference numeral 20, which is in two parts 22,24, divided by a line of perforations 26. The coupon part 24 is the competition entry proper which is submitted by the entrant to the competition organisers. It bears a picture 28, which may be a photograph taken during a football match but from which photograph the ball has been discreetly erased. The other coupon part 22 bears instructions 30 for entering the competition and has at least one sheet in the form of a self-adhesive sticker 32 removably attached to its surface.

The sticker 32 is opaque and is marked upon its surface with a number of small crosses, of which only a small number are shown for reasons of clarity. For example, the or each sticker may carry, say, from 20 to 500 crosses, perhaps 50 to 150 in the illustrated version.

In order to enter the competition represented by FIG. 2, the entrant removes the sticker 32 from the coupon part 22 and places it in a position on the picture 28 wherein he believes the obliterated ball should be. He then separates the two parts of the coupon by tearing along the perforations 26 and submits the separated coupon part 24 to the competition organisers. If, among the entries submitted, he has succeeded in placing the sticker 32 such that one of the crosses overlies the centre of the obliterated ball, he will be a or the competition winner. If there is no such correct entry, then the winner may be the entrant who is most nearly correct. The entrant who submitted the winning entry can be identified by the competition organisers publicising the serial number (indicated in the drawings by the reference numeral 34) which appears on both coupon parts and the winning entrant can prove his identity by producing the coupon part 22 corresponding to the successful entry.

In a further embodiment of the invention (not illustrated), a plurality of sheets, one side of each of which is coated with a water-activated adhesive, are interconnected separably by perforations in the manner of a sheet of postage stamps. Each sheet is a relatively small square, rectangle, hexagon or other preferably continuously mutually contacting shape, is transparent so that it can be applied in precisely the chosen position on an entry coupon, and carries an indelible display of a multiplicity of precisely defined crosses arranged in a predetermined pattern. The interconnected sheets can be of the same or different areas, and carry the same or different numbers of crosses at the same or different concentrations, substantially as in the preferred first embodiment hereinbefore described. The variants applicable to said preferred embodiment concerning the colour, opacity, shape, and arrangement in a roll or as part of the entry coupon of the sheets are equally well applicable to this postage stamp-like embodiment. The usual but not obligatory way of moistening the adhesive is by licking.

Typical concentrations of crosses envisaged include, for example, 100 crosses in 1 to 6 square centimeters, with sheets carrying, say, from 20 to 500 crosses.

We claim:

1. A method of entering a pictorial competition including a) displaying a picture of an event upon an entry coupon, b) providing multiple identical indicia in a selected amount on an indicia member of selected size that is positioned away from the picture, and c) applying the indicia member with the selected amount of identical indicia to the picture to identify possible locations of a missing element from the picture.

2. A method according to claim 1, wherein the indicia are crosses.

3. A method according to claim 2 wherein the crosses are applied to the picture by removing the indicia member from its position away from the picture and transferring the indicia member directly onto the picture.

4. A method according to claim 2, wherein the crosses are applied by attaching the indicia member adhesively to the picture.

5. Competition entry means comprising, a sheet for attachment to a pictorial entry coupon, which sheet carries a multiplicity of identical indicia displayed on a first face thereof, and an adhesive coating on the other face thereof for attachment to a picture on the pictorial entry coupon, such that the indicia identify possible locations of a missing element from the picture.

6. Competition entry means according to claim 5, comprising a plurality of said sheets upon a common backing.

7. Apparatus for conducting a pictorial competition, which apparatus comprises a pictorial entry coupon and a sheet having a multiplicity of identical indicia displayed on a first face thereof and having an adhesive coating on the other face thereof, whereby said sheet may be adhesively attached to said pictorial entry coupon to display said multiplicity of indicia upon said coupon.

8. Apparatus according to claim 7, wherein said pictorial entry coupon and said sheet are separate.

9. Apparatus according to claim 7, wherein said sheet is removably attached to an area of said pictorial entry coupon other than an area of said coupon bearing the picture.

10. Apparatus according to claim 9, wherein said pictorial entry coupon is in two separate parts, to one of which said sheet is removably attached and upon the other of which the picture is displayed.

11. Apparatus according to claim 9, comprising a plurality of said sheets, all removably attached to said pictorial entry coupon.

12. Apparatus according to claim 7, wherein said sheet is transparent.

13. Apparatus for conducting a pictorial competition of the type wherein an entrant is required to identify the position of an element in a picture displayed upon an entry coupon, which apparatus comprises a pictorial entry coupon bearing a photograph thereon from which said element has been omitted, and at least one sheet having a multiplicity of identical indicia displayed on a first face thereof and having an adhesive coating on the other face thereof, said at least one sheet being removably attached to an area of said pictorial entry coupon other than the area thereof bearing said photograph, whereby said sheet may be removed from said coupon and re-applied to said coupon upon said picture, whereby to identify a multiplicity of possible positions of said element.

14. Apparatus for conducting a pictorial competition, which apparatus comprises a pictorial entry coupon and a sheet having a multiplicity of identical indicia removably displayed upon said sheet for transfer together from said sheet to said coupon, whereby to display said multiplicity of indicia together upon said coupon and thereby indicate a multiplicity of positions upon said coupon, whereby to submit a multiplicity of entries to said competition.

* * * * *